United States Patent [19]

Bellavin, deceased

[11] 3,993,510

[45] Nov. 23, 1976

[54] THIXOTROPIC CHEMICAL CONVERSION MATERIAL FOR CORROSION PROTECTION OF ALUMINUM AND ALUMINUM ALLOYS

[75] Inventor: Peter N. Bellavin, deceased, late of New Castle, Del., by Anna K. Bellavin, legal representative

[73] Assignee: The United States of America as represented by the Secretary of the Navy, Washington, D.C.

[22] Filed: May 21, 1975

[21] Appl. No.: 579,515

[52] U.S. Cl. ..... 148/6.2; 148/6.27

[51] Int. Cl.[2] ..... C23F 7/26

[58] Field of Search ..... 148/6.2, 6.16

[56] References Cited

UNITED STATES PATENTS

| | | | |
|---|---|---|---|
| 2,030,601 | 2/1936 | McDonald | 148/6.16 |
| 2,796,370 | 6/1957 | Ostrander et al. | 148/6.2 |
| 3,150,015 | 9/1964 | Boyer et al. | 148/6.2 |
| 3,582,368 | 6/1971 | Salzberg | 148/6.2 X |
| 3,591,425 | 7/1971 | Shimanaka et al. | 148/6.2 |
| 3,703,419 | 11/1972 | Esler et al. | 148/6.2 X |

*Primary Examiner*—Ralph S. Kendall

*Attorney, Agent, or Firm*—R. S. Sciascia; Henry Hansen

[57] ABSTRACT

A conventional Newtonian chemical conversion material is mixed with water, a thickener and a surfactant to produce a thixotropic non-Newtonian chemical conversion material with improved application properties.

4 Claims, No Drawings

THIXOTROPIC CHEMICAL CONVERSION MATERIAL FOR CORROSION PROTECTION OF ALUMINUM AND ALUMINUM ALLOYS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to chemical conversion materials for aluminum and aluminum alloys and in particular the invention relates to a thixotropic chemical conversion material.

Chemical conversion materials are applied to aluminum and aluminum alloys to react therewith to form a corrosion resistant coating thereon and to provide a surface for improved bonding of organic finishes such as paints and lacquers which may be applied to the coating.

A currently used conversion material is formulated from chromates, inorganic salts such as phosphates or fluorides, catalysts, activators and accelerators. Although this material reacts with aluminum to form an adequate corrosion resistant coating it has several drawbacks. When the material is prepared in an aqueous solution its consistency is too thin for proper spray application, i.e., rapid run off occurs. The material does not always produce a uniform coating of sufficient thickness for maximum corrosion protection. The material cannot be applied to vertical and curved surfaces without rapid run off which produces uneven discontinuous coatings of varying thickness resulting in ineffective corrosion protection and paint adhesion as well as waste of material.

SUMMARY OF THE INVENTION

Accordingly it is an object of this invention to provide an improved chemical conversion material which overcomes the aforesaid drawbacks. It is a further object of this invention to provide an improved chemical conversion material having superior application performance, which can be sprayed onto vertical and curved surfaces in the form of a wet, uniform, gelatinous, reactive layer and which reacts with aluminum and aluminum alloys to form a uniform, continuous, corrosion resistant and paint adhering coating.

It is a further object of this invention to provide an improved chemical conversion material having thixotropic properties to thereby prevent rapid run off and to reduce the amount of material needed for a particular application.

It is a further object of this invention to provide an improved chemical conversion material which deposits approximately twice as much coating in a given time as compared to currently used conversion materials and which remains in a wet activated state for periods in excess of fifteen minutes.

It is a further object of this invention to provide an improved chemical conversion material which reduces chromate pollution of water, which gives greater corrosion protection than currently used materials and which can be removed with minimum effort by rinsing with water when spent.

These and other objects are achieved as follows. A standard chemical conversion material such as that disclosed in Example IX of U.S. Pat. No. 2,796,370 is mixed with water, a thickener such as CAB-O-SIL and one of two alternative surfactants such as Tergitol or ARP-2 to produce a non-Newtonian thixotropic chemical conversion material having improved application properties.

Other objects, advantages and novel features will become apparent from the following detailed description.

DESCRIPTION OF THE PREFERRED EMBODIMENT

The following examples are illustrative of the composition of the present invention. It is understood that various changes may be made therein in relation to proportions of ingredients and numerous other compositions can readily be evolved in light of the teachings disclosed herein. All parts given are by weight.

| | Example (1) | Example (2) | Example (3) | Example (4) | Example (5) | Example (6) |
|---|---|---|---|---|---|---|
| Ingredients | | | | | | |
| Standard Chemical Conversion Coating Material | 4.0 | 3.5 | 3.0 | 2.5 | 1.5 | 2.5 |
| Thickener | 3.0 – 5.0 | 3.0 – 5.0 | 3.0 – 5.0 | 3.0 – 5.0 | 3.0 – 5.0 | 3.0 – 5.0 |
| Surfactant No. 1 | 0.1 – 0.4 | 0.1 – 0.4 | 0.1 – 0.4 | 0.1 – 0.4 | 0.1 – 0.4 | — |
| Surfactant No. 2 | — | — | — | — | — | 0.1 – 0.4 |
| Water | 100 | 100 | 100 | 100 | 100 | 100 |

The formulation of example (1) deposits a coating at a rapid rate. It can be most usefully applied over small areas for touch-up maintenance operations. The formulations of examples (2), (3), (4) and (5) respectively produce less dense (thinner) coatings. The formulation of example (6) releases film depositing constituents at a slow rate to thereby form a uniform lightweight coating. The formulation of example (4) has been extensively tested and is the preferred formulation for large scale applications.

The amount of standard chemical conversion material may vary from 1.5 to 4.5 parts by weight; if the amount of standard material is increased above 4.5, coating formation becomes too rapid to permit formation of a coating with good adhesion and the thickness of the coating becomes difficult to control. The amount of thickener may vary from 3.0 to 5.0 parts by weight with 4.0 parts by weight deemed preferable. Use of less than 4.0 parts thickener requires that additional surfactant be used to obtain the same thixotropic stability obtained with 4.0 parts thickener. Both surfactants may vary from 0.1 to 0.4 parts by weight; use of more than 0.4 parts result in excessive thixotropic properties and spray application of the formulation becomes difficult.

By standard chemical conversion material is meant a material such as those set forth in U.S. Pat. No.

2,796,370 the contents of which are incorporated by references as though fully set forth herein. Such a material consists essentially of hexavalent chromium, a fluorine bearing compound and a soluble cyanide selected from the group consisting of ferricyanide and ferrocyanide. As an example, a particular standard chemical conversion material comprises in percent by weight, as set forth in Example IX of said patent,

| | |
|---|---|
| Chromic acid | 54 |
| Potassium ferricyanide | 11 |
| Barium nitrate | 20.5 |
| Sodium fluosilicate | 14.5 |

The foregoing dry powder mix is normally prepared in an aqueous solution with about 0.1 to 5 ounces of the dry powder mix per gallon of water.

The standard chemical conversion material must meet the requirements of Military Specification MIL-C-5541 and MIL-C-81706.

By thickener is meant a material having the following properties: (a) ability to form a homogeneous, non-hard settling, gelatinous, thixotropic fluid; (b) ability to make the standard conversion material cling to vertical and curved aluminum, aluminum alloy surfaces without rapid run off or sagging; (c) thickener must be a non-oxidizable, inert, inorganic, finely divided, preferably siliceous material, that has the property to render acid and oxidizing solutions of electrolytes into thixotropic fluids; (d) thickener must be suitable for spray application using a standard spray gun system without clogging spray orifices at approximately 30 psi pressure and must be suitable for spray application using a self-pressurized non-flammable aerosol disposable spray kit such as that set forth in Military Specification MIL-S-22805 (Wep); (e) thickener must be a hydrophillic material (compatible with water; water wettable); and (f) thickener must retain moisture in excess of 15 minutes without complete drying, while the applied wet coating is reacting with the aluminum or aluminum alloy substrate.

A suitable thickener for use in the invention is CAB-O-SIL grade M-5 manufactured by the Cabot Corporation of Boston, Massachusetts. CAB-O-SIL is a submicroscopic fire-dry fumed silica. On a dry basis CAB-O-SIL is approximately 99% silicon dioxide and is practically free from contaminating metallic oxides. Typical properties of Grade-MS CAB-O-SIL are as follows: specific gravity 2.2, refractive index 1.46, surface area 200±25 $m^2/gm$ (BET), nominal particle size 0.012 micron, density 2.3 lbs./cu. ft. max., 4% aqueous dispersion pH 3.5 – 4.2.

By surfactant is meant a material having the following properties: (a) low foam formation; (b) noncorrosive to metals; (c) resistant to acids; (d) resistant to oxidation by oxidizing agents such as chromic acid solutions; (e) suitable for use in high electrolyte systems; (f) in liquid form for ease of handling; (g) good reactability; (h) usable at elevated temperatures; (i) biodegradable; (j) preferably must contain a compound with a chain of eight or more carbons on one end of the surfactant molecule and a hydroxyl, amino, or carboxylic group at the other end of the surfactant molecule; and (k) non-ionic.

The surfactant causes the thickener (CAB-O-SIL) chains to migrate toward each other, and link together causing an increase in viscosity and thixotropy.

Surfactant No. 1 is a liquid non-ionic surface active agent comprising a 19–20% by weight water solution of poly-oxy ethylene (23) lauryl ether, a white waxy solid which is soluble in water, alcohol and propylene glycol and which may be obtained from Atlas Chemical Co., Wilmington, Delaware, under the name BRIJ-35. Surfactant No. 1 may also be obtained from The Richardson Co., Allied Kelite Division, Des Plaines, Illinois, under the name ARP2.

Surfactant No. 2 is a non-ionic, surface active, biodegradable polyethylene glycol ether of a linear alcohol containing from 10 to 25 moles of ethylene oxide. Surfactant No. 2 may also be obtained from Union Carbide under the name Tergitol 15-S-12.

The standard chemical conversion material is a Newtonian fluid and is an electrolyte. When the standard material is applied to vertical and curved surfaces it runs off and the previously mentioned drawbacks of this material ensue. The material of this invention is a non-Newtonian thixotropic fluid which clings to vertical and curved surfaces thereby eliminating rapid run off.

Rendering the standard material thixotropic was not accomplished by merely adding an arbitrarily chosen thickening agent. Any substance having thickening properties cannot be effectively used with the standard conversion material. The thickener must not be degraded by the highly acidic and oxidizing agents which are present in the standard conversion material.

Through experimentation it was determined that CAB-O-SIL satisfies the requirements of the postulated thickener. CAB-O-SIL added to a solution of the standard conversion material does change its rheological properties. However, it was discovered that CAB-O-SIL alone does not produce permanent thixotropic properties in the standard conversion material. Therefore, a second substance, a surfactant, which is compatible with the mixture of the standard conversion material and the CAB-O-SIL is introduced for viscosity stabilization. The end result is the transformation of the standard conversion material from a Newtonian fluid to a non-Newtonian fluid having permanent thixotropic properties.

Obviously many modifications and variations of the present invention are possible in the light of the above teachings. It is therefore to be understood that within the scope of the appended claims the invention may be practiced otherwise than as specifically described.

I claim:

1. A thixotropic chemical conversion material, for use in the corrosion protection of aluminum and aluminum alloys, comprising, in parts by weight: 1.5 to 4.0 parts conversion material comprising an aqueous solution of chromic acid, potassium ferricyanide, barium nitrate and sodium fluosilicate; 3.0 to 5.0 parts thickener comprising colloidal silicon dioxide; and 0.1 to 0.4 parts surfactant comprising an aqueous solution of poly-oxy ethylene lauryl ether.

2. A thixotropic chemical conversion material, for use in the corrosion protection of aluminum and aluminum alloys, comprising, in parts by weight:

2.5 parts conversion material comprising an aqueous solution of chromic acid, potassium ferricyanide, barium nitrate and sodium fluosilicate;

3.0 to 5.0 parts thickener comprising colloidal silicon dioxide; and 0.1 to 0.4 parts surfactant comprising polyethylene glycol ether of a linear alcohol.

3. A thixotropic chemical conversion material according to claim 1 further including 100 parts water.

4. A thixotropic chemical conversion material according to claim 2 further including 100 parts water.

* * * * *